United States Patent [19]

Savnik

[11] Patent Number: 4,882,955

[45] Date of Patent: Nov. 28, 1989

[54] ANGLED HEAD HAMMER

[76] Inventor: Davorin Savnik, Pod hrasti 34, Yu-61,000 Ljubljana, Yugoslavia

[21] Appl. No.: 53,820

[22] Filed: May 26, 1987

[51] Int. Cl.[4] ..... B25D 1/00

[52] U.S. Cl. ..... 81/20; 81/488

[58] Field of Search ..... 81/20–27, 81/488; 173/90

[56] References Cited

U.S. PATENT DOCUMENTS

| | | | |
|---|---|---|---|
| 3,130,762 | 4/1984 | Kerr | 81/26 |
| 4,039,012 | 8/1977 | Cook | 81/25 |
| 4,144,919 | 3/1979 | Miller | 81/20 |

*Primary Examiner*—Frank T. Yost
*Assistant Examiner*—James L. Wolfe
*Attorney, Agent, or Firm*—Philip D. Junkins

[57] ABSTRACT

A hand-held hammer formed of: a hammer head including a principal elongated body portion of square cross-sectional configuration and having at least one nail striking surface of square shape at one end of the body portion; and an elongated hammer handle affixed at its forward end in substantially perpendicular orientation to the body portion of the hammer head. The hammer head is turned by 45° from the axis of the hammer handle whereby a pair of opposing edges of the head is in alignment with the axis of the handle and whereby the square nail striking surface of the head provides right and left side corners of striking surface area for setting nails and the square shape of the nail striking surface improves the hammer user's nail driving accuracy during the rearward to forward or upward to downward swing movement of the hammer.

3 Claims, 2 Drawing Sheets

ANGLED HEAD HAMMER

BACKGROUND OF THE INVENTION

The present invention relates to hammers. More particularly, the invention relates to hammers as tools to drive nails in wood and other materials. Carpenters principally use the classic claw hammer, which has a steel head with a circular face or striking surface at one end and claws for pulling out nails at the other end. Other types of one-hand hammers include the stone hammer, the bricklayer's hammer, and the machinist's or ball peen hammer.

The combination of human hand and arm, in using a hammer, is very precise in the forward and rearward or up and down direction of swing movement, but relatively inaccurate in side-to-side orientation during such swing movement.

It is an obJect of the present invention to provide a hand-held hammer which, when used by one trained to manual dexterity or skill in carpentry or when used by a relatively unskilled person, improves the accuracy of use in driving nails; and It is a further object of he invention to provide a one-hand carpentry hammer which reduces the danger of damage or injury to fingers when holding small nails during their initial setting prior to final nail driving.

These and other objects and advantages of the invention will become apparent from the following summary and detailed descriptions of the invention taken in conjunction with the accompanying drawing figures.

SUMMARY OF THIS INVENTION

The present invention relates to one-hand carpentry hammers which, when used by the carpentry artisan or person unskilled in hammer use, improves the ease and accuracy of setting and driving nails. The head configuration and its orientation with respect to the hammer handle, in accordance with the invention, also reduces the danger of damage or injury to the fingers of the user when holding small nails during their initial placement and setting prior to full swing driving of same. The metallic head of the present hammer, at least in its face surface (striking surface) and principal body portion, is of square face shape and cross-sectional configuration. Further, this square form or shape of hammer head is turned by 45° from the axis of the hammer handle whereby the striking surface of the head will hit nail-head aim points 20–30% more accurately during the forward and rearward or up and down swing movement of the hammer in the setting and driving of nails. The 45° turned orientation of the square head of the hammer provides a unique right or left side corner of striking surface area of the hammer head for setting small (finger-held) nails while providing improved visibility of such nails during the initial setting procedure.

BRIEF DESCRIPTION OF THE DRAWING FIGURES

The invention is illustrated in the accompanying drawing figures in which.

Figure 5:
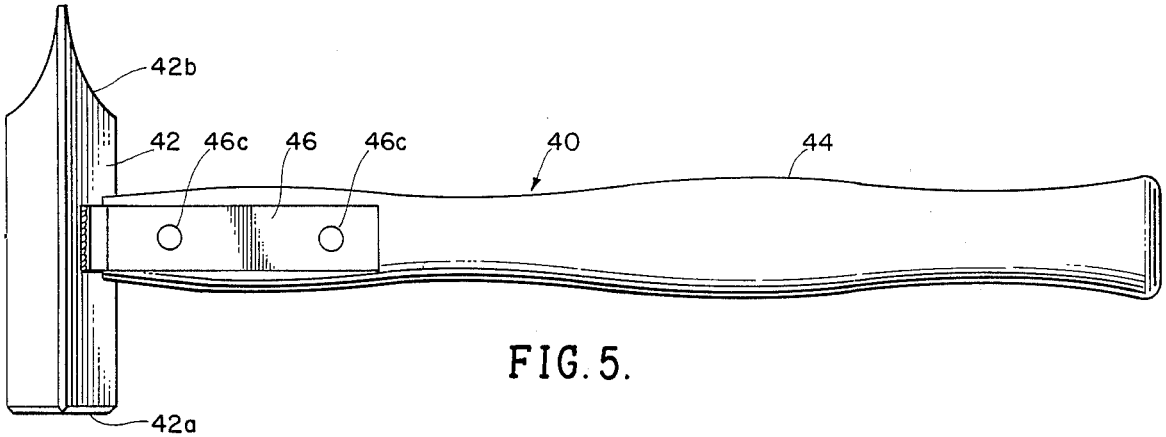
FIG. 5 is a full side view of another embodiment of the hammer structure of the invention including a claw component of the hammer head portion of the hammer structure.
Figure 7A:
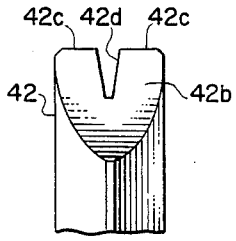
Figure 7B:
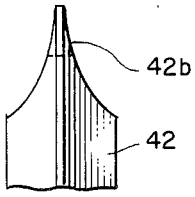
Figure 8:
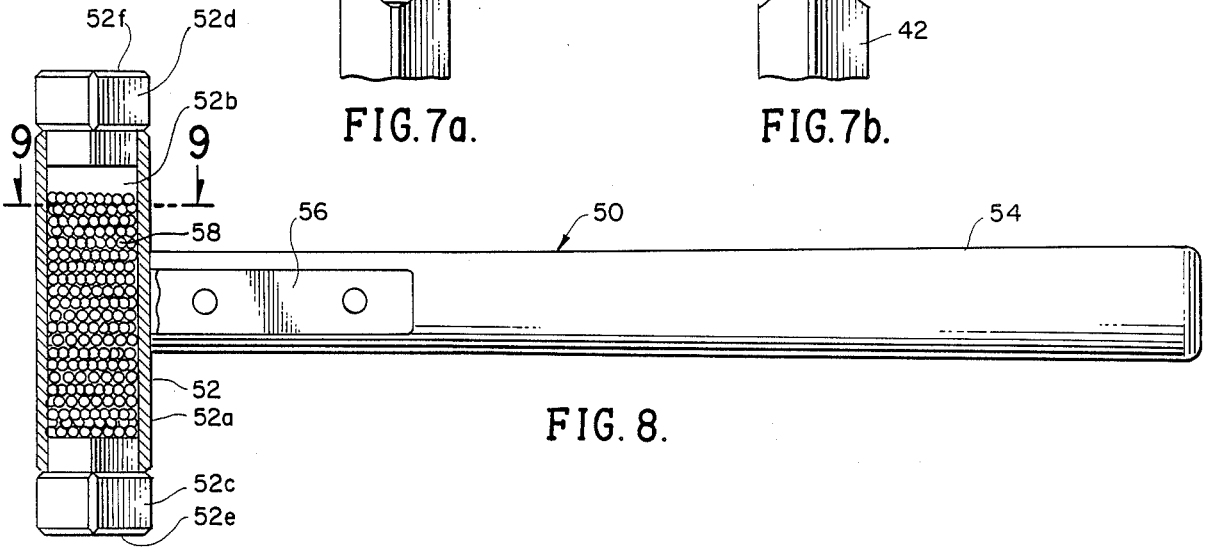
Figure 9:
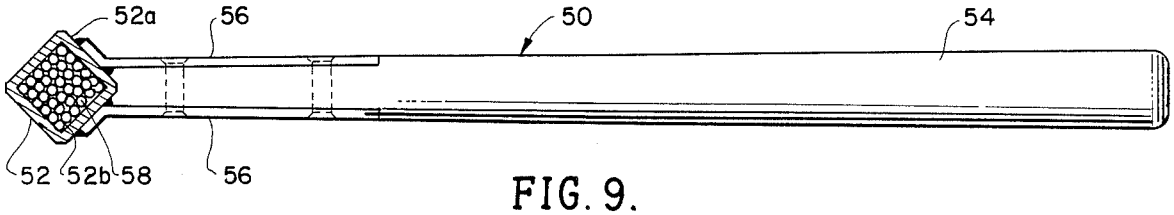

FIGS. 7*a* and 7*b* are partial views of the hammer head portion of the hammer structure of FIG. 5 with multiple claws as components of such head portion;

FIG. 8 is a full side view (partially in section) of a further embodiment or the hammer structure of the invention including means for rendering the hammer structure recoil-less; and FIG. 9 is a top view of the hammer structure of FIG. 8.

DETAILED DESCRIPTION OF THE INVENTION

Figure 1:
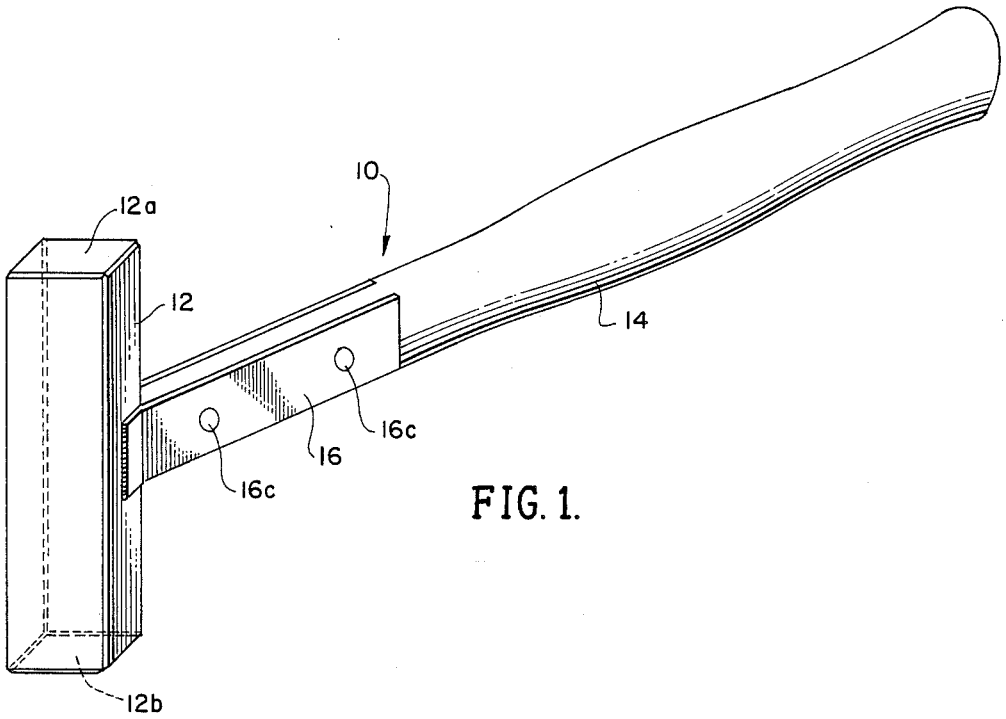
FIG. 1 is a perspective view of the basic hammer head and handle structure of the present invention.
Figure 2:
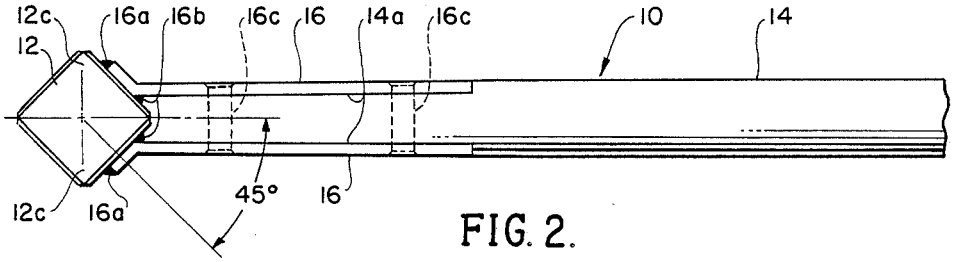
FIG. 2 is top view of the hammer head and handle (partial view of its length only) of the hammer structure of FIG. 1.

A first embodiment of the angled head hammer of the invention is shown in FIGS. 1 and 2 of the drawing sheets. The hammer 10 is comprised essentially of a metallic hammer head 12 and a hammer handle 14, preferably made of wood or molded plastic material. The hammer head 12, in accordance with the invention, is of square cross-sectional configuration and has two opposite square striking surfaces 12*a* and 12*b*. The head 12 is affixed to handle 14 by parallel metallic supporting straps or tangs 16 disposed in side handle indents 14*a* along each side of the handle. Such straps or tangs, as shown in FIG. 2, are welded to the head 12 by weld beads 16*a* and 16*b* and are attached to handle 14 by rivets 16*c*.

As particularly shown in FIG. 2, the hammer head 12 is turned by 45° from the axis of the hammer handle 14. Through its square cross-sectional configuration and turned orientation, the hammer head 12 provides the user with additional striking surface area (approximately + 21.5%) with respect to a hammer head having a circular striking area of diameter equal to the dimension of a side of the square striking area. Further, the turned orientation of the hammer head 12 provides unique side corner areas 12*c* of striking surface area of the head for setting small nails while providing improved visibility of such nails to the hammer user during the initial setting procedure.

Figure 3:
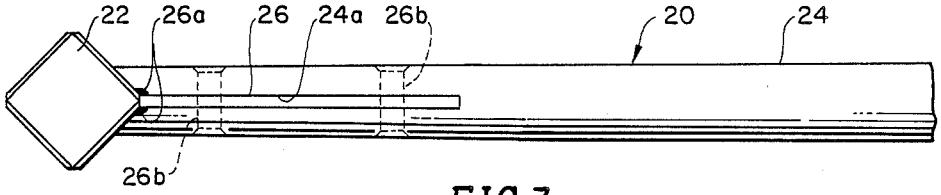
FIG. 3 is a top view of the hammer structure of FIG. 1 including modified structural means for connecting the handle (partial view of its length only) to the hammer head.
Figure 4:
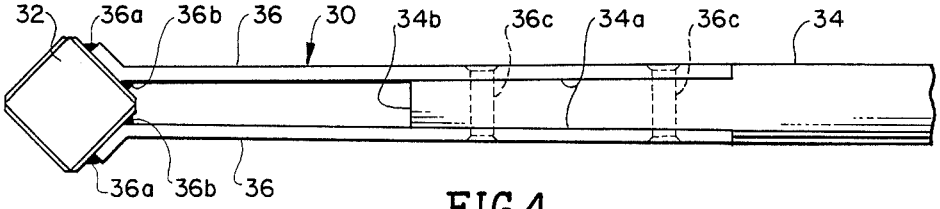
FIG. 4 is a top view of the hammer structure of FIG. 1 including another structural means for connecting the handle (partial view of its length only) to the hammer head.

FIGS. 3 and 4 show, in top view presentation, two alternative means of affixing a metallic hammer head of the invention to a hammer handle. In FIG. 3 the hammer 20 is comprised of hammer head 22 and hammer handle 24. The head 22, of square cross-sectional configuration, is affixed to the handle 24 by a single central tang 26, welded to head 22 by weld beads 26*a* and secured in a groove 24*a* within handle 24 by rivets 26*b*. In FIG. 4 the hammer 30, of the invention, is comprised of hammer head 32 and hammer handle 34. The head 32 is affixed to the handle 34 by parallel tangs 36 disposed in side indents 34*a* along each side of the handle. Such tangs extend beyond the end 34*b* of handle 34 and are welded to head 32 by weld beads 36*a* and 36*b* and are attached to handle 34 by rivets 36*c*.

Figure 6:
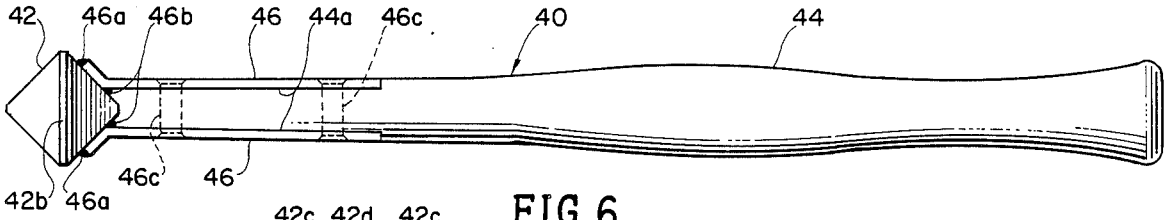
FIG. 6 is top view of the hammer structure of FIG. 5.

Referring now to FIGS. 5, 6, 7*a* and 7*b*, there is illustrated a further embodiment of the angled head hammer of the invention. Again, the hammer 40 is comprised essentially of a metallic (steel) hammer head 42 and a hammer handle 44. The hammer head 42, as shown in FIGS. 5 and 6 and in accordance with the invention, is of square cross-sectional configuration and has a square striking surface 42*a* at one end of head 42 and a single nail-pulling claw 42*b* at the other end of the head. The head 42 is affixed to handle 44 by parallel metallic supporting straps or tangs 46 disposed in handle indents 44*a* along each side of the handle. As in the case of the hammer embodiment shown in FIG. 2, the straps or tangs 46 are welded to the head 42 by weld beads 46*a* and 46*b* and are attached to handle 44 by rivets 46*c*. FIGS. 7*a* and 7*b* show a partial front view (FIG. 7*a*) and a partial side view (FIG. 7*b*) of claw end 42*b* of the hammer head 42. As shown, the claw end 42*b* includes two claws 42*c* and a "V" notch 42*d* for engagement with a nail head to be pulled.

A still further embodiment of the angled head hammer of the invention is illustrated in FIGS. 8 and 9. The hammer, generally designated by the numeral 50, is comprised of a metallic hammer head 52 and a hammer handle 54. The hammer head 52 is of square, tubular cross-sectional configuration with walls 52*a* defining a central cavity 52*b*. The tubular hammer head 52 includes end plugs 52*c* and 52*d* affixed at and within each end of the head by any well-known means. The end plugs 52*c* and 52*d* may each be made of steel and present a square striking surface 52*e* and 52*f*, respectively, or one of such plugs, for example plug 52*d*, may be made of Nylon or other strong plastic material. As in the case of the angled head hammers illustrated in FIGS. 1, 2, 5 and 6, the hammer head 52 is turned in its mounted position with respect to handle 54 by 45° from the axis of the handle and is maintained affixed to the handle by parallel metallic supporting straps or tangs 56 welded to head 52 and riveted to handle 54. The central cavity 52*b* of hammer head 52 is partially filled with small lead shot or pellet material 58 (approximately 60% to approximately 90% of the cavity volume) which acts, during the nail striking action of the hammer 50, to make the hammer recoil-less.

From the foregoing detailed descriptions of preferred embodiments of the angled head hammer of the present invention, it has been made clear that the metallic head of the hammer, at least in its face surface (striking surface) and principal body portion, is of square face shape and cross-sectional configuration. Further, the square form and shape of the hammer head is turned by 45° from the axis of the hammer handle whereby the striking surface of the head will hit nail-head aim points 20–30% more accurately during the forward and rearward or up and down swing movement of the angled head hammer in the setting and driving if nails. As previously indicated, the 45° turned orientation of the square head of the hammer provides a unique right and left side corner of striking surface area of the hammer head for setting small (finger-held) nails while providing improved visibility of such nails to the hammer user during the initial setting procedure.

While the invention has been described in connection with particular structural embodiments of the angled head hammer, many other modifications of the basic hammer structure will be apparent to those skilled in the art. Accordingly, such modifications are to be included within the spirit and scope of the invention as defined by the following claims.

What I claim is:

1. A hand-held hammer comprised of: a hammer head including a principal elongated body portion of square cross-sectional configuration having two pairs of diametrically opposed edges along the length thereof and having at least one nail striking surface of square shape at an end thereof; and an elongated hammer handle affixed at its forward end to the body portion of said hammer head, said hammer head being positioned with respect to said handle so that the pairs of said edges of said head extend in substantially perpendicular orientation to the long axis of said handle with the plane formed by a first pair of said edges oriented in alignment with said axis and the plane formed by the second pair of said edges oriented in perpendicular alignment with said axis whereby the square nail striking surface of said head provides right and left side corners of striking surface area for setting nails and the square shape of said nail striking surface oriented as determined by the aforesaid position of the hammer head with respect to said hammer handle improves the hammer user's nail driving accuracy during the rearward to forward and upward to downward swing movement of said hammer.

2. A hand-held hammer as claimed in claim 1 wherein the hammer head has a square nail striking surface at each end of its elongated body portion.

3. A hand-held hammer as claimed in claim 1 wherein the hammer head has at least one nail-pulling claw at one end of its elongated body portion.

* * * * *